US005947828A

United States Patent [19]

Fabbri

[11] Patent Number: 5,947,828

[45] Date of Patent: Sep. 7, 1999

[54] RIDE FOR FUN FAIRS

[75] Inventor: Licinio Fabbri, Bergantino, Italy

[73] Assignee: FAR Fabbri S.R.L., Bergantino, Italy

[21] Appl. No.: 09/101,025

[22] PCT Filed: Nov. 27, 1996

[86] PCT No.: PCT/IT96/00230

§ 371 Date: Jun. 29, 1998

§ 102(e) Date: Jun. 29, 1998

[87] PCT Pub. No.: WO97/27922

PCT Pub. Date: Aug. 7, 1997

[30] Foreign Application Priority Data

Jan. 30, 1996 [IT] Italy ..... MO96A0010

[51] Int. Cl.[6] ..... A63G 27/08

[52] U.S. Cl. ..... 472/30; 472/44; 472/47

[58] Field of Search ..... 472/44–47, 40, 472/29, 32

[56] References Cited

U.S. PATENT DOCUMENTS 2,328,852 9/1943 Shepherd .

2,562,324 7/1951 McBride ..... 472/40

FOREIGN PATENT DOCUMENTS 927 088 10/1947 France .

94 20 530 9/1995 Germany .

WO 91/13661 9/1991 WIPO .

*Primary Examiner*—Kien T. Nguyen

*Attorney, Agent, or Firm*—Browdy and Neimark

[57] ABSTRACT

The invention relates to a ride for a fun fair. It includes an upright to which two first arms are coupled, each of which oscillates on a vertical oscillation plane. The oscillation planes are parallel and located on opposite sides of the upright. A capsule is associated to each arm and oscillates solidly therewith. The capsule affords space to a plurality of passengers on board. The upright rotates about a vertical axis (y—y) thereof, so that during operation the oscillation planes of the arms rotate about the vertical axis solidly with the upright.

8 Claims, 2 Drawing Sheets

RIDE FOR FUN FAIRS

TECHNICAL FIELD

The invention relates to a ride for fun fairs. In particular the invention relates to a ride comprising an upright to which two arms are associated with ability to perform a pendular oscillation. Each of the two arms oscillates on a respective oscillation plane, the two oscillation planes being located on opposite sides of the upright. A capsule, capable of containing a plurality of passengers, is associated to each arm and is solid in rotation therewith.

BACKGROUND ART

A ride of this type is present in the prior art, in which each capsule is constituted by a closed cockpit inferiorly provided with a floor and inside which there are seats for passengers. When the ride is stationary and in boarding position, the passengers enter the cockpit and on sitting down are rendered secure in their seats, resting their feet on the floor of the cockpit. During the ride, the arms are commanded to oscillate with growing amplitude up until the cockpits are upside-down; these movements afford the passengers pleasurable sensations.

U.S. Pat. No. 2,328,852 shows an amusement ride apparatus comprising two arms each of which is able to perform pendular oscillations on oscillation planes located on opposite sides of the upright. A part of the upright is able to rotate about an axis of rotation and the oscillation planes are able to rotate solidly with the part thereof. The apparatus comprises means for commanding a rotation of the rotatable part of the upright. Passenger carriages, each equipped with suitable seats, are made to pass along a complex orbit which is a combination of rotary movements about both horizontal and vertical axes. FR-A-927 088 discloses a ride for fun fairs having an upright to which two arms are associated with ability to perform a pendular oscillation and providing a part of the upright which is able to rotate.

DE-U-94 20 530 discloses a swing-type fairground amusement ride having spoke-type rotor rotatably driven by a motor around a horizontal shaft, with a passenger carrier formed as circular arc segment at an end of a spoke. The passenger carrier is equipped with seats which are arranged in a radial direction on the under side of the passenger carrier and provide the passengers with freely hanging foot positions. The passengers during rotation are pressed against their seats by centrifugal force.

WO-A-9113661 relates to a roundabout which comprises a vertical mast with two tubular gondolas associated thereto, wherein the passengers are subjected to a complete revolution about a vertical axis and a complete revolution about a horizontal axis.

DISCLOSURE OF INVENTION

The main aim of the present invention is to provide a ride of the above-mentioned type which can offer the passengers new sensations with respect to the prior art. This aim is achieved by the ride of the invention, as it is characterised in the claims.

An advantage of the present invention is that it attains the set aim while being constructionally simple and economical.

A further advantage is that the ride is extremely safe for the passengers.

A still further advantage is that the ride can carry a high number of passengers as well as rapid and easy boarding and alighting.

Further characteristics and advantages of the present invention will better emerge from the detailed description that follows of an embodiment of the invention, illustrated by way of example and not to be considered limiting in the accompanying figures of the drawings, in which.

With reference to the figures, 1 denotes in its entirety a ride for a fun fair, comprising an upright 2, or vertical column, provided with a base 3 which can rest on the ground or can be mounted on a frame, such as for example a transporter truck.

The ride further comprises a pair of first arms 4 and 5, each of which is associated to the upright 2 and can perform pendular oscillations there-about. Each of the first arms 4 and 5 oscillates on a respective vertical oscillation plane. The oscillation planes are distanced one from another and located on opposite sides of the upright 2. Each first arm 4 and 5 can perform oscillations of a growing amplitude up to a limit of a complete rotation, leading to the upturning of the first arms and, as will become clearer hereinbelow, an upturning also of the passengers travelling on the ride.

Figure 1:
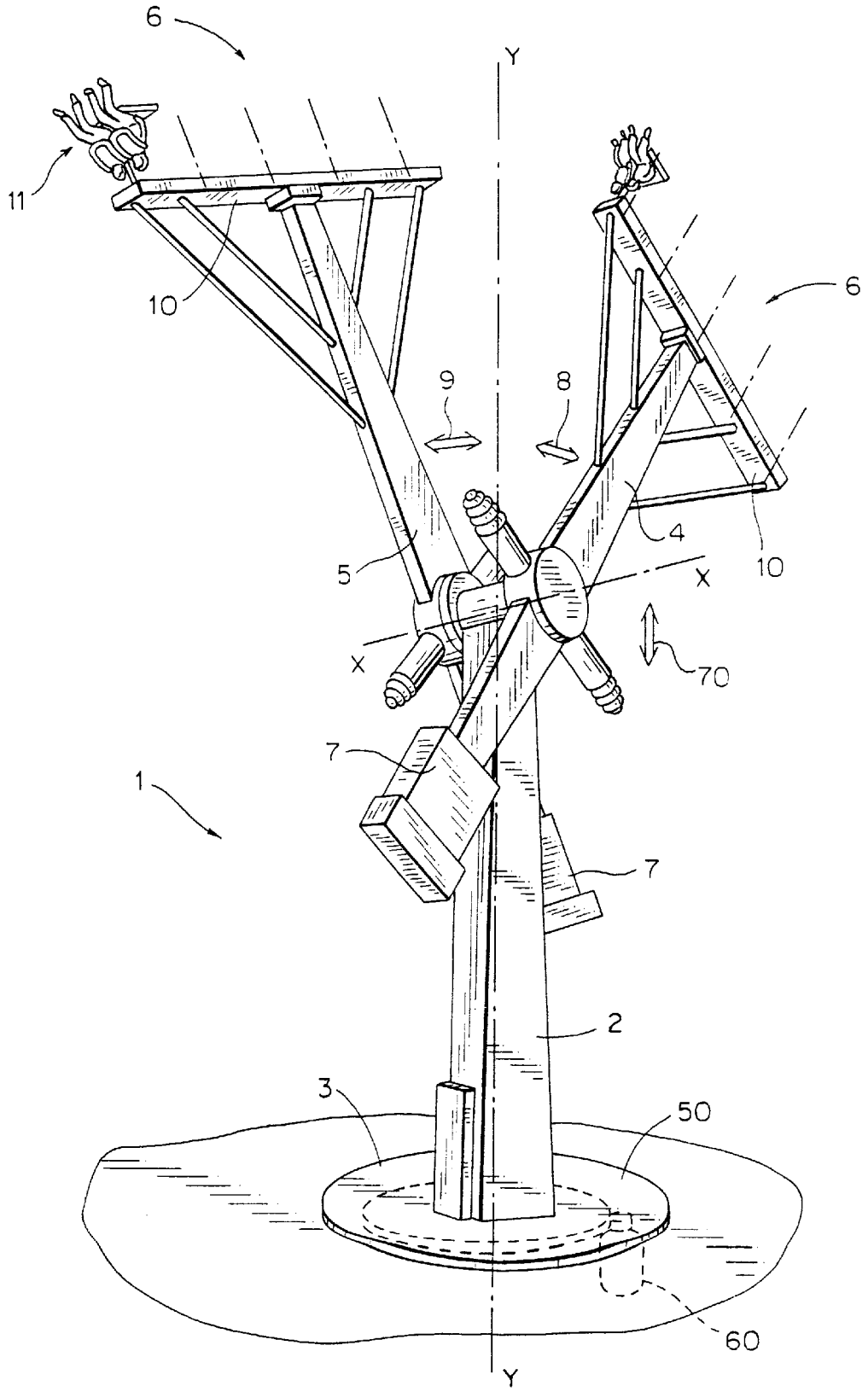
FIG. 1 shows a schematic vertical-elevation perspective view of the ride.

The two first arms 4 and 5 oscillate about a horizontal axis x—x common to both. The oscillation pivots, which are coaxial, of the first arms are situated at the upper end of the upright 2. The first arms 4 and 5 are commanded to oscillate in opposing directions: when one arm oscillates in a given direction, the other will oscillate in the opposite direction. FIG. 1 shows a configuration assumed by the ride 1 during use. 8 and 9 denote the swinging directions of the first arms 4 and 5.

A capsule 6 is associated to each of the first arms 4 and 5 and is solid in oscillation thereto. Each capsule 6 affords seating for a plurality of passengers, and is fixed to an end of a relative first arm 4 or 5 while a counterweight 7 is arranged at the other end of the relative first arm 4 or 5. The motor for commanding the oscillations of the first arms 4 and 5 is of known type and not represented in the figure.

According to the invention, the upright 2 can rotate about an axis y—y which is preferably vertical and located in the space comprised between the two oscillation planes, so that during operation the oscillation planes of the first arms 4 and 5 both rotate about the rotation axis y—y, solidly with the upright.

For this reason the upright 2, in the example in FIG. 1, is rotatably mounted by means of a fifth wheel of known type 50 on the base 3, and can rotate about axis y—y on command of a motor of known type 60.

Preferably the upright 2 is mounted on the base 3 in such a way that the vertical rotation axis y—y corresponds to the geometric axis of the upright 2 itself and is arranged halfway between the two first arms 4 and 5 and is normally incident to their common rotation axis x—x.

The upright 2 can also, selectively, assume a first configuration, lowered, for loading and unloading passengers, in which configuration the capsules 6 are relatively close to the base 3 of the upright 2, and a second configuration, raised, which is a working configuration, in which the lowest point reached by the capsules 6 in their oscillating motion is relatively distant from the base 3 of the upright 2. This motion is indicated by arrow 70 in FIG. 1. For this purpose the upright 2 can be, for example, of a telescopic type. Each capsule 6 comprises a second arm 10, solid to a relative first arm 4 or 5 and situated at a peripheral end thereof. The second arm 10 extends prevalently along the oscillation plane of the relative first arm 4 or 5 and is practically perpendicular to the first arm 4 or 5.

According to the invention, a plurality of support elements 11 are associated each to one of the second arms 10. Each of the support elements 11 can receive one passenger, leaving the passenger's legs free and suspended. The support elements 11 are arranged in a line parallel to the relative second arm 10.

Each support element 11 comprises, solid to the second arm 10, a bar 12, more or less perpendicular to the second arm 10 and developing in a direction which is radial and external-facing with respect to the second arm 10. At least one seat 13, also more or less perpendicular to the bar 12, is associated thereto. In the example each bar 12 solidly bears four seats 13 arranged two by two in such a way that a passenger seated on a seat 13 can be sitting next to another passenger with a further passenger seated back-to-back.

Figure 2:
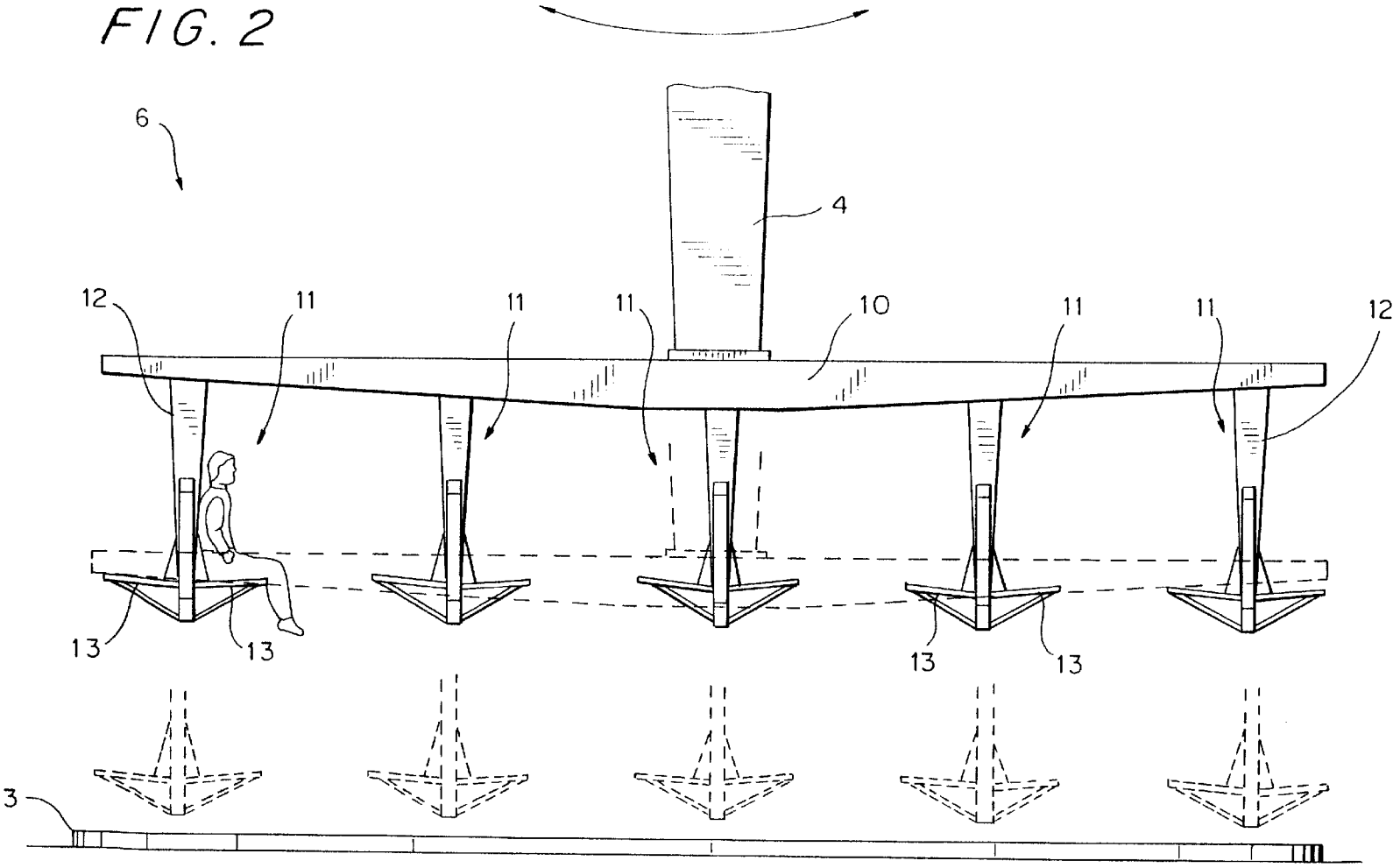
FIG. 2 shows a schematic lateral view of a detail of the ride.

The functioning of the ride is as follows: first, in the initial configuration, the passengers can board or alight and the arms are stationary in the vertical position with the capsules 6 in lowered position; then the upright is raised into the second configuration. FIG. 2 shows (in a broken line) some support elements 11 with the upright 2 in the first, lowered configuration.

Then the upright 2 is rotated about the vertical axis y—y and the first arms 4 and 5 are caused to oscillate with growing amplitude up to a maximum oscillation in which the passengers are upturned completely and the arm proceeds to make a complete rotation.

In a further embodiment of the invention, not illustrated, the upright comprises a first, lower part, rigidly fixed to the base, and a second, superior part, rotatably coupled to the first part by means of a thrust bearing rotatable about the axis y—y of the upright. The first arms are oscillatably pivoted (at either side of the upright) so that during operation, as in the first embodiment, the capsule motion comprises a composition of two movements constituted by a pendular oscillation with an upturning followed by a complete rotation about vertical axis y—y. The thrust bearing can be located, on the upright, in any intermediate position between the base and the upper end bearing the pivots of the first arms. The most important factor is that the first arms 4 and 5 and consequently the capsules can rotate about axis y—y and add this rotation to their other, pendular, motion.

The raising and lowering movement of the upright of the ride guarantees both ease of boarding and alighting on the part of the passengers and the operational safety of the ride. With the upright in the raised configuration, the passengers do not run the risk of bumping their feet against the base of the ride. Alternatively, a boarding footplate could be used at the boarding and alighting stage. The footplate would then be distanced so that the passengers would not risk bumping against them with their feet.

The ride affords the passengers special sensations, due primarily to the combination of the above-mentioned motions, that is, the first arms' rotation about axis y—y and swinging about axis x—x. There is thus a sequence of normally unattainable positions. Further, the passengers on the ride draw enjoyment from the experience of oscillating on vertical planes while having their feet free, suspended and swinging.

A still different sensation is experienced by the passengers due to the fact of having their legs free and suspended and of having the impression of being on board a capsule subjected to motion comprising both rotation and swinging.

All the above-described rides with pendular-swinging arms have two arms, for reasons of stability and balance of the ride itself. It is obvious that the invention could be applied to a ride (not in existence) provided with one arm alone. Also obvious are the operative modalities of such a one-armed ride and the constructional differences that would be required.

I claim:

1. A ride for fun fairs, comprising:

an upright (2);

a pair of first arms (4, 5) each of which is coupled to the upright (2) to perform pendular oscillations on oscillation planes located on opposite sides of the upright (2), at least a part of the upright (2) to which said first arms (4, 5) are coupled being rotable about an axis (y—y) of rotation, whereby the oscillation planes rotate with said at least a part of the upright (2);

at least one capsule (6) coupled to each of said first arms (4, 5) for oscillation there with, said capsule (6) including places on-board for a plurality of passengers;

wherein each capsule (6) includes leg room wherein passengers on board have their legs free to swing, wherein each capsule (6) comprises a second arm (10) solidly connected to a respective one of said first arms (4, 5) and situated at a peripheral end therof, said second arms (10) including generally on the oscillation plane of said first arms (4, 5), at least one row of support elements (11) being associated and arranged parallel to each of said second arms (10), each of said support elements (11) being able to receive at least two passengers seated back to back.

2. The ride as in claim 1, characterized in that said axis (y—y) of rotation coincides generally with an axial extension of the upright (2).

3. The ride as in claim 1, characterized in that the upright (2) is rotatably mounted on a base (3) to rotate about said axis (y—y) of rotation.

4. The ride as in claim 1, characterized in that the upright (2) comprises a fixed lower part, rotatably coupled to a rotating part of said upright (2).

5. The ride as in claim 1, characterized in that said second arms (10) are substantially perpendicular to said first arms (4, 5).

6. The ride as in claims 1, characterized in that each support element (11) comprises: at least one bar (12), solidly constrained to one of said second arms (10), which bar (12) is substantially perpendicular to said one of the second arms (12) and which extends in a peripheral direction thereto; at least one seat (13) being associated to said at least one bar (12), said at least one seat (13) being positioned substantially perpendicular to said at least one bar (12).

7. The ride as in claim 1, characterized in that said upright (2) selectively assumes a lowered first position for boarding and alighting of the passengers, in which first position the at least one capsule (6) is relatively close to the base (3) of the upright (2), and a raised second position in which the ride operates, in which second position a lowest point reached by the at least one capsule in its oscillating motion is relatively distant from said base (3) of said upright (2).

8. The ride as in preceding claim 1, characterized in that each support element (11) comprises four seats (13) arranged two by two such that a passenger seated on a seat (13) sits next to another passenger with another passenger seated back-to-back.

* * * * *